US008176921B2

(12) United States Patent
Bazargani

(10) Patent No.: US 8,176,921 B2
(45) Date of Patent: May 15, 2012

(54) DYNAMICALLY INFLATABLE THERAPEUTIC SUPPORT AND METHODS OF USING THE SAME

(75) Inventor: Daryoush Bazargani, Berlin (DE)

(73) Assignee: LeniMed GmbH (DE)

( * ) Notice: Subject to any disclaimer, the term of this patent is extended or adjusted under 35 U.S.C. 154(b) by 429 days.

(21) Appl. No.: 11/592,303

(22) Filed: Nov. 2, 2006

(65) Prior Publication Data

US 2007/0061976 A1 Mar. 22, 2007

Related U.S. Application Data

(63) Continuation-in-part of application No. PCT/DE2005/000830, filed on May 3, 2005.

(30) Foreign Application Priority Data

May 4, 2004 (DE) ..... 10 2004 022 284

(51) Int. Cl.
*A61F 5/56* (2006.01)
*A61F 5/34* (2006.01)
*A47C 20/00* (2006.01)

(52) U.S. Cl. ..... 128/848; 128/118.1; 5/636; 5/630; 5/645; 5/644; 5/655.3

(58) Field of Classification Search ..... 128/118.1, 128/848; 602/902; 5/644, 645, 655.3
See application file for complete search history.

(56) References Cited

U.S. PATENT DOCUMENTS 2,239,300 A * 4/1941 O'Dell et al. ..... 267/117
2,688,142 A * 9/1954 Jensen ..... 5/638
4,850,067 A * 7/1989 Latorre ..... 5/636
5,016,303 A * 5/1991 Tanaka et al. ..... 5/636
5,142,720 A * 9/1992 Kelso et al. ..... 5/630
5,168,590 A * 12/1992 O'Sullivan ..... 5/490
5,477,867 A * 12/1995 Balkanyi ..... 128/848
5,815,862 A * 10/1998 Rygiel ..... 5/632
6,386,201 B1 * 5/2002 Fard ..... 128/848
6,779,526 B2 * 8/2004 Kawamura ..... 128/848
7,007,330 B2 * 3/2006 Kuiper et al. ..... 5/715
7,082,633 B1 * 8/2006 Maarbjerg ..... 5/636
2008/0092908 A1 * 4/2008 Costa ..... 128/848

* cited by examiner

*Primary Examiner* — Patricia Bianco
*Assistant Examiner* — Victoria J Hicks
(74) *Attorney, Agent, or Firm* — Wood, Phillips, Katz, Clark & Mortimer

(57) ABSTRACT

A therapeutic cushion (1) having a plurality of fluid-filled chambers (2, 3, 4, 5, 6), with each chamber having an internal volume that is independently adjustable. In a pillow embodiment, air-filled chambers are dynamically regulated in response to a monitored behavior or characteristic of a resting user. Air cushion (1) includes a lower chamber (2) upon which the other chambers are arranged. First or basic chamber (3) extends laterally along, and is directed inwardly from, a rear edge of underlying chamber (2). Adjoining first chamber (3) are first and second supporting chambers (4, 5), these being separated from one another to leave a region (10) that is disposed between their ends (7, 8) and bisected by center line (9). Region (10) is intended to accommodate the resting user's head. A second lateral chamber (6) extends laterally along and is directed inwardly from a forward edge of underlying chamber (2) to adjoin supporting chambers (4, 5), providing a neck support. To configure the cushion (1) to provide a therapeutic treatment for snoring, at least one sensor is included to detect and monitor snoring intensity and thereby provide feedback to the dynamic pressure regulation process.

21 Claims, 3 Drawing Sheets

DYNAMICALLY INFLATABLE THERAPEUTIC SUPPORT AND METHODS OF USING THE SAME

REFERENCE TO RELATED APPLICATIONS

This application is a continuation-in-part of pending prior international application number PCT/DE2005/000830, filed on May 3, 2005 and entitled ERGONOMIC PILLOW THAT CAN BE INDIVIDUALLY ADJUSTED, which designated the United States and had an international priority date of May 4, 2004.

BACKGROUND OF THE INVENTION

1. Field of the Invention

The invention relates generally to systems and methods for supporting all or a portion of the human body and, more particularly, to an inflatable support that is dynamically adjustable in accordance with the therapeutic requirements of a user.

2. Discussion of the Background Art

Applying the latest in "state of the art" technical standards, there is an enormous variety of pillows on the market which provide ergonomic adjustment of a pillow to conform to a sleeper's head. The pillow's composition, or its shape and size, are advertised by each brand as determining qualities for its ergonomic function. It is a fact, however, that the prerequisite for a deep, restful sleep is the correct anatomical support of the head and neck. Thus, true ergonomic support cannot be achieved unless the shape and size of a pillow are adjustable to the particular requirements of its user. Pillows of the above-described type are not truly adjustable despite the limited flexibility that is afforded by the soft materials used in their construction. A user can not verify whether his or her pillow is acceptable until after several days of actual, real-world use. Buying and trying many pillows in pursuit of such a strategy can quickly become a costly procedure, and there is no guarantee that an acceptable one will even be found. In recognition of this deficiency, a variety of so-called adjustable pillow systems have been proposed.

Published patent application US 2004/0006822 A1, for example, describes an adjustable pillow for therapeutic purpose, featuring a number of chambers, a number of elements of support, and a basic sheath which in turn is attached onto a top sheath in order to yield the supporting elements of the top chamber. The supporting elements are designed to be positioned within one of the chambers. The height of each chamber is adjustable by varying the number of supporting elements positioned in each chamber. In addition, the chambers can include a chamber for supporting the neck, one for supporting the head and a pair of lateral supporting chambers.

JP 02264612 A describes a pillow which is aimed at preventing snoring by positioning the user's back and head such that the vertebrae of the neck and thorax are aligned in a natural s-curve and the face angle is kept at about 5 degrees. This is obtained by employing a nuclear corpus at the top as well as a smaller nuclear corpus providing support for the rear part of the head and maintaining the face angle at about 5 degrees and also an inferior nuclear corpus for support of the necks vertebrae.

GB 2 383 947 A describes a medical device providing either neck-or back pain relief and featuring an inflatable supporting cushion and an inflating device connected to it. This device is to be positioned between the patient's head and a headrest, and it supports the neck as well as the side of the head. The inflating device includes a pump and a pilot device, e.g. a timing clock, allowing the inflation and deflation of the cushion to be obtained by a repeating cycle via a two-way inflation and deflation gate to the cushions chamber. As a result the movements of the patients back head will move his neck relieving from pain or preventing it.

EP 1 369 065 A1 describes an inflatable headrest, featuring a pair of distant aircushions connected by a joining element between them. Each cushion is shaped by one cushion at least which is rolled upon itself or folded and fixed in its position.

DE 199 30 818 C1 is a device for preventing snoring effectively by a governed shifting of the sleepers head position on the pillow. The pillow consists of an air cushion subdivided into a number of chambers. Air pressure is governed via a controlling unit in connection with a source for air pressure increase and the source for air pressure decrease.

The disadvantage of this device lies in that, in spite of changing the sleepers head position by shifting the inclination of the cushions resting surface in order to prevent snoring, there is no ergonomic adjustment of the pillow to the sleepers head. This may lead to a poor sleeping position, resulting in strain of the subjects neck muscles and causing head-or neck ache over the long run.

A continuing need therefore exists for a support system that can be adjusted in accordance with the individual preferences of a user in order, for example, to accommodate the particular size and the shape of that user's head and to thereby provide a more stable and comfortable support thereof.

A need also exists for a support system that can be adjusted in a manner that provides a therapeutic benefit such, for example, as relief from a sleep disorder (e.g., chronic snoring, sleep apnea, and the like).

SUMMARY OF THE INVENTION

The aforementioned deficiencies are addressed, and advance is made in the art, by a therapeutic cushion having a lower chamber defining an interior volume adapted to receive and store a fluid under pressure and a number of upper chambers overlying the lower chamber. The first upper chamber defines an interior volume adapted to receive and store a fluid under pressure and overlies a first upper surface region of the lower chamber. A second upper chamber is disposed above the lower chamber, the second upper chamber also defining an interior volume adapted to receive and store a fluid under pressure and overlying a second upper surface region of the lower chamber. Third and fourth upper chambers are disposed above the lower chamber and define an interior volume adapted to receive and store a fluid under pressure, the third and fourth upper chambers adjoining the first and second upper chambers and being separated by a gap region extending upward from a head supporting surface of the lower chamber.

In accordance with an illustrative embodiment of the invention directed toward the abatement of snoring, a sensor is provided for monitoring the user's snoring activity. A chamber adjustment system, responsive to detected snoring activity, is operative to independently adjust the size and/or firmness of each chamber so as to dynamically adjust the position of the user's head and thereby reduce an intensity of snoring. Preferably, the levels of pressurization are adjusted in an obtrusive manner (i.e., such that they do not deviate any more than necessary, from the baseline pressurization levels previously set by the user, to attenuate the snoring).

The head supporting surface region of the lower chamber may adjusted upward by introducing additional air into the interior volume of the lower chamber, and adjusted downward by withdrawing air from the interior volume of the lower chamber. Likewise, the interior volume of each upper chamber can be independently adjusted to achieve a particular setting that is best suited ergonomically for the particular user. While preserving such a suitable arrangement as a baseline, the adjustment means incorporates a control unit executing an algorithm that adjusts the interior volumes of the chambers when snoring intensity exceeds a given threshold.

BRIEF DESCRIPTION OF THE DRAWINGS

An enhanced understanding of the invention will be achieved by reference to the detailed description of the invention which follows, taken in conjunction with the accompanying drawings, in which.

DETAILED DESCRIPTION OF THE INVENTION

Figure 1:
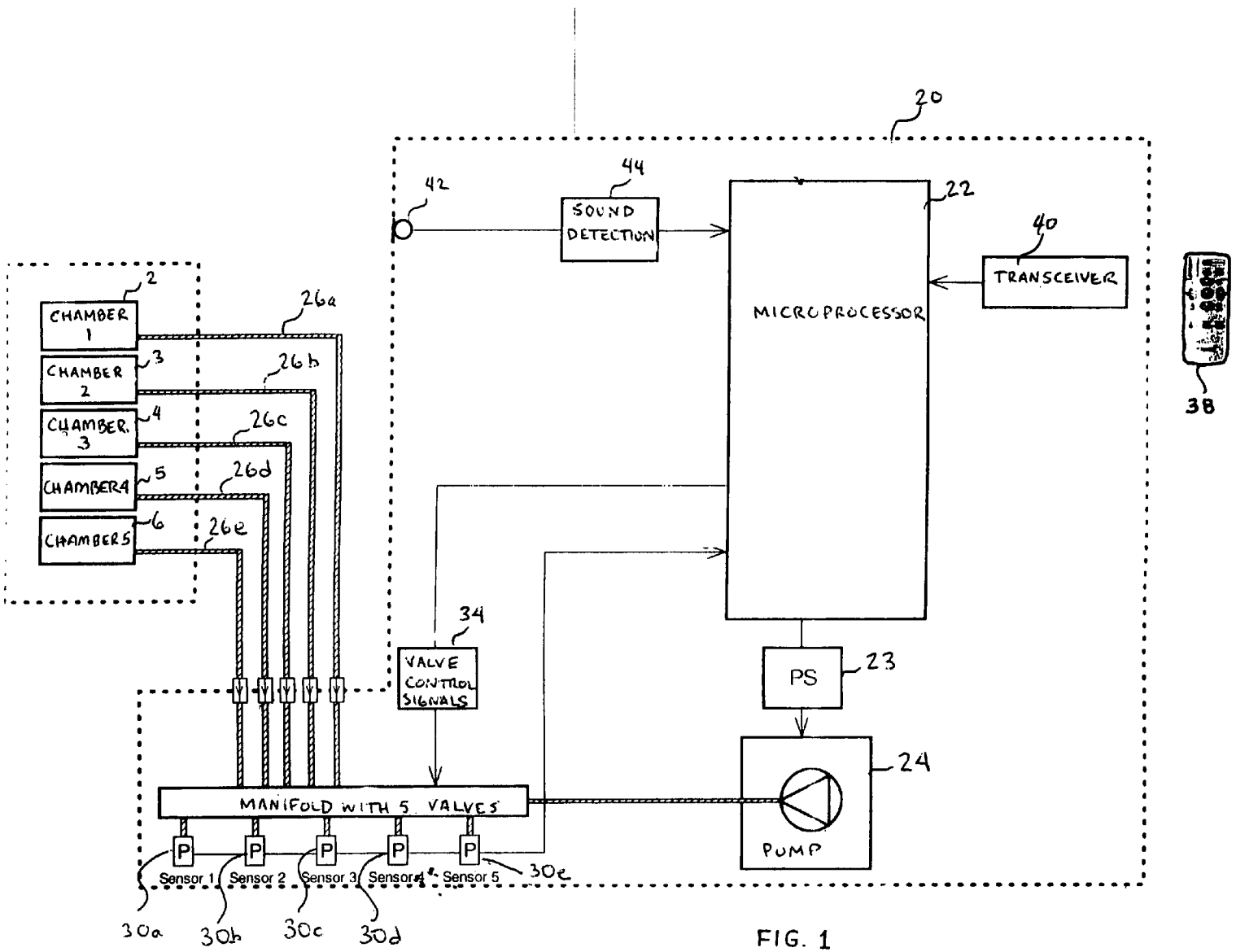
FIG. 1 is a block schematic diagram depicting a five-chambered therapeutic support system constructed in accordance with an illustrative embodiment of the present invention.

In FIG. 1 there is shown a therapeutic support structure 10 constructed in accordance with an illustrative embodiment of the present invention. For a purpose which will be described shortly, support structure 10 consists of five independently inflatable chambers indicated generally at 12, 13, 14, 15 and 16, respectively, with the inflatable chambers 13, 14, 15, 16, that are upper chambers, overlying and contacting four separate surface regions of the chamber 12. To this end, each chamber is defined by walls of an elastomeric material capable of air tight expansion and contraction. Although five independently inflatable chambers are shown in the exemplary embodiment illustrated and described in detail herein, a wide variety of arrangements are contemplated by the inventor herein. Thus, by way of additional non-limiting examples, alternate therapeutic support systems constructed in accordance with the teachings of the invention may include a larger or smaller number of inflatable chambers or even a combination of inflatable chambers and foam inserts or segments.

With continued reference to FIG. 1, there is shown a control unit 20 comprising a microprocessor 22 configured to execute an algorithm stored in an associated memory (not shown) for operating, via a pump relay 23, an air pressurization pump 24. A respective delivery tube, indicated generally at 26*a*-26*e*, introduces air into or removes air from a corresponding one of chambers 12-16 by way of a five-valve manifold indicated generally at 28. A pressure sensor, indicated generally at 30*a*-30*e*, is operatively associated with each delivery tube and develops a respective signal indicative of the pressure within each corresponding chamber. Valve controller 34, under the control of microprocessor 22, is operative to establish fluid communication between one or more of chambers 12-16 and pump 24. Energization of air pump 24 will cause air under pressure to flow from pump 24 through manifold supply tube 35 and then through only those of the five valves of manifold 28 which happen to be in an open condition, thereby reaching a corresponding chamber that requires additional inflation. Conversely, when air pump 24 is not energized, air will exit any chamber whose corresponding valve is open and exit the system via a discharge valve (not shown) disposed along the fluid communication path of supply tube 35, thereby deflating the affected chamber(s).

As will be readily appreciated by those skilled in the art, by operation of the valves within manifold 28, the discharge valve along delivery tube 35, and air pump 24, it is possible to precisely control the firmness and external dimensions of each chamber—thereby allowing a user to customize support system 10 according to his or her own unique preferences and ergonomic requirements using, for example, a man machine interface in the form of a remote control device 38 adapted to communicate wirelessly with a transceiver 40 coupled to microprocessor 22. Moreover, and in accordance with an especially preferred embodiment of the invention, it is possible to dynamically control the dimensions and/or firmness of one or more of chambers 12-16 to address a monitored behavior or characteristic such, for example, as snoring intensity or loudness. To this end, and for a purpose which will be described in detail shortly, illustrative system 10 includes a microphone 42 and an acoustic energy detector or other sound detection circuit 44 operative to detect and monitor the intensity and/or amplitude of snoring or breathing sounds.

Figure 2:
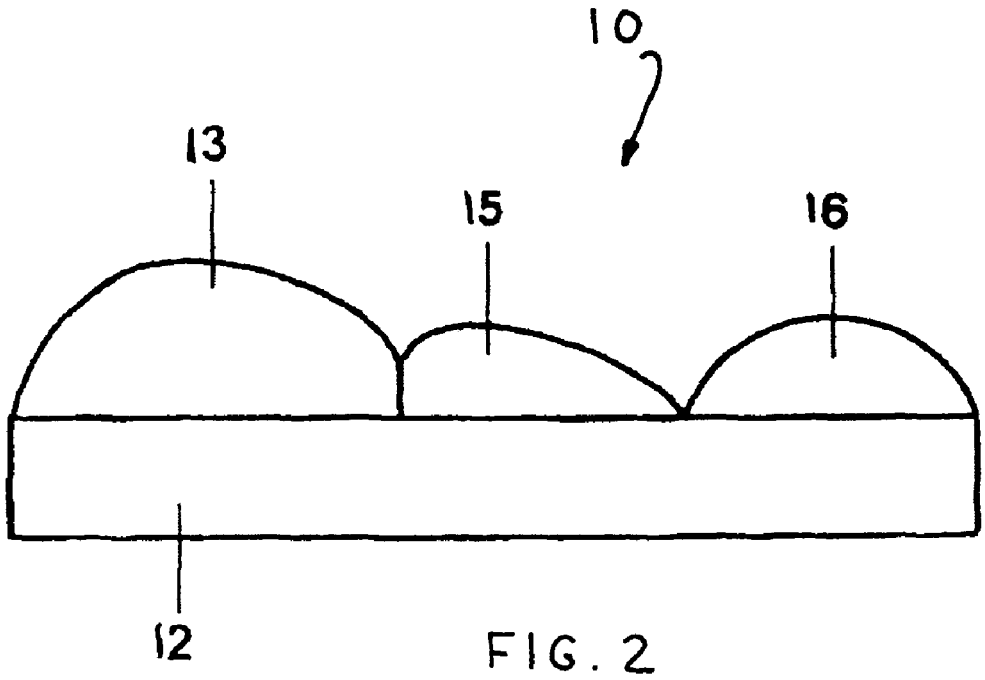
FIG. 2 is a top plan view of a therapeutic support system depicting the exemplary embodiment of FIG. 1.
Figure 3:
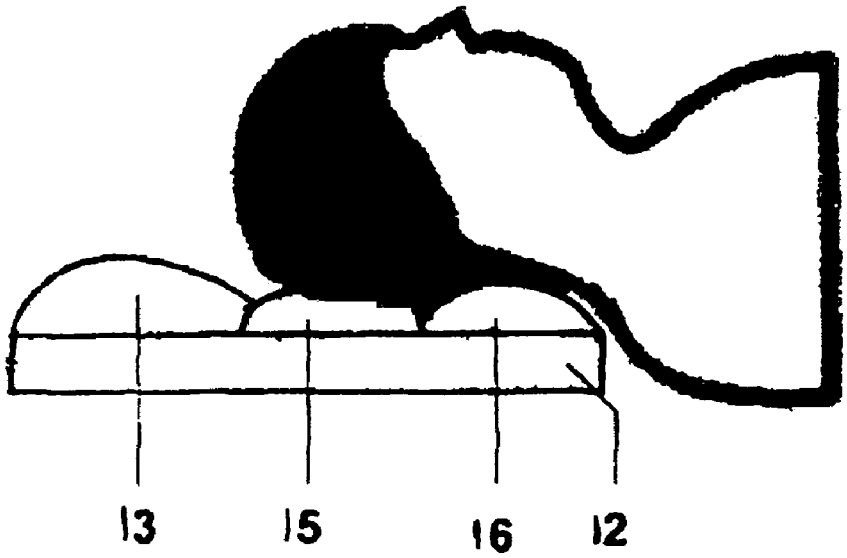
FIG. 3 is a cross-sectional view of the exemplary embodiment depicted in FIG. 2, taken across section B-B.
Figure 4:
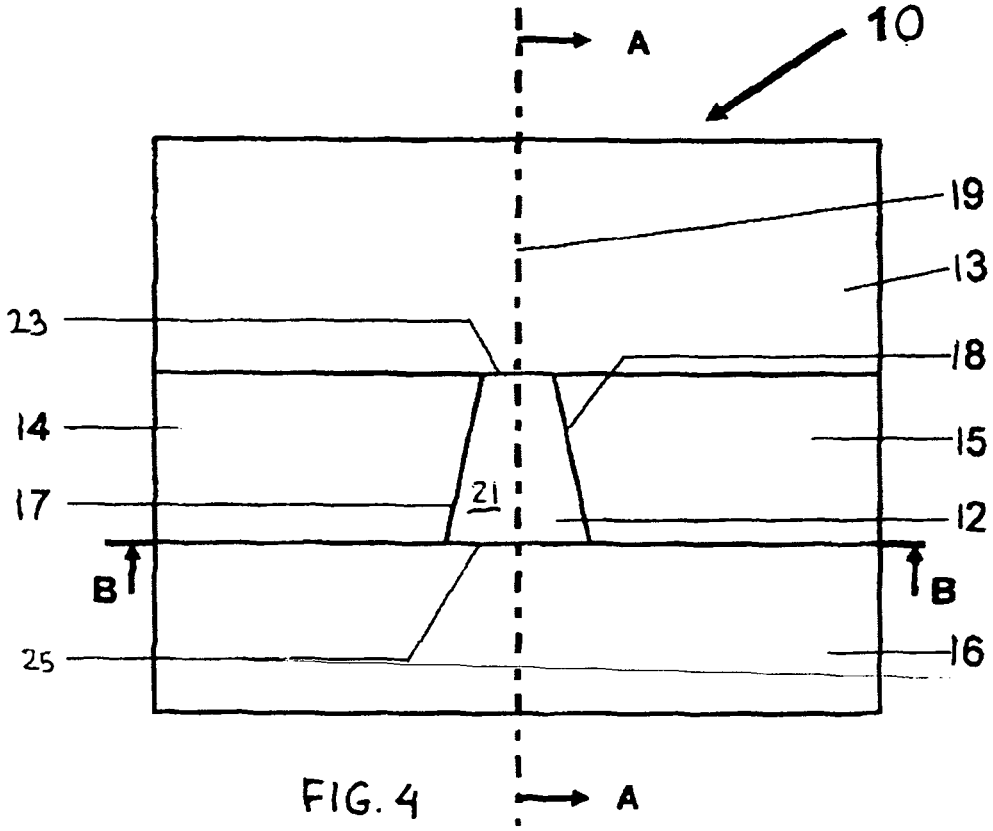
FIG. 4 is cross-sectional view of the exemplary embodiment depicted in FIG. 2, taken across section A-A.
Figure 5:
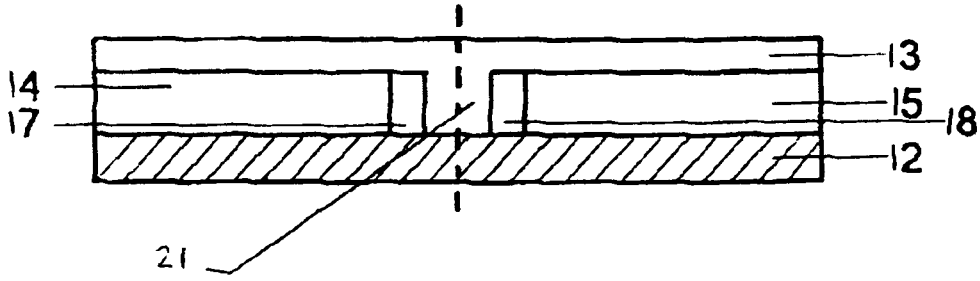
FIG. 5 is a schematic side view depicting the position of a sleeping user's head upon the exemplary embodiment of FIG. 2.

Turning now to FIGS. 2-4, it will be seen that the illustrative support system 10 includes a lower member/chamber 12 that underlies all of the other inflatable upper chambers 13, 14, 15, 16. Lower chamber 12 basically allows for a vertical extension, that is, it enables an up or down adjustment of the entire arrangement according to the sleeper's requirements—depending upon the amount of air introduced by air pump 24. First upper chamber 13 is located toward the rear of lower chamber 12 and stretches transversally up to the lateral sides thereof. First upper chamber 13 serves the purpose of exerting a gentle supporting force upon the top of a sleeper's head—preventing his or her head from sliding backwards.

As best seen in FIG. 3, adjoining first upper chamber 13 are a pair of lateral supporting chambers 14 and 15, having head supporting faces 17 and 18, respectively, that face each other and diverge from the rear edge of lower chamber 12 toward the front edge of lower chamber 12. Each head supporting chamber 14, 15 thus stretches laterally from one side of lower chamber 12 towards the center line 19 of support 10, ending close to center line 19 and providing for a gap or region 21 defined by the upper surface of lower chamber 12. Gap 21 extends between the facing sides 17, 18 of head supporting chambers 14, 15 and is dimensioned such that when the sleeper's head rests upon the upper surface of chamber 12, lateral head support is provided by facing sides 17, 18 of chambers 14 and 15, respectively. As seen in FIG. 4, the combined lateral dimension of the third and fourth chambers 14, 15 is greater than the lateral dimension of the gap/region 21. The inclined shaping of surfaces 17 and 18 of chambers 14 and 15, and the parallel surfaces 23 and 25 of adjoining chambers 13 and 16 define a trapezoidal zone that allows the sleepers head to sink in comfortably and rest upon the upper surface of lower chamber 12, thereby stabilizing it. Upper chamber 16 adjoins head supporting chambers 14 and 15 and stretches transversally at the front area of lower chamber 12 up to its sides.

From the foregoing, it will be appreciated that the shape and height of the illustrative system depicted in FIG. 3 is adjustable to the body size and shape of any individual user simply by inflating and deflating each single chamber independently. Initial, baseline customization is obtained by operating a key pad associated with control unit 20.

As indicated earlier, in addition to the aforementioned ergonomic function, a therapeutic support constructed in accordance with the invention can implement, via an appropriate microprocessor executed algorithm, a dynamic adjustment scheme which is responsive to a monitored and/or detected characteristic or behavior of the user. By way of example, if the user has a snoring problem, one or more of the inflatable chambers can be dynamically adjusted to gently reposition the user's head. Pressure sensors 30*a*-30*e* detect the momentary position of the users head relative to each chamber. Responsive to levels of acoustic energy detected via microphone 42 identifiable as snoring sounds by the control algorithm, a change in the sleepers head position is achieved by automatic adjustments in the inflation of one or more chambers. As a consequence, the upper pharynx' soft parts are shifted, permitting free ventilation of the trachea and causing snoring to stop. In accordance with a preferred embodiment of the invention, a learning algorithm is employed such that the control unit will inflate/deflate the chambers in a way that shifts the sleeper's head until snoring sounds are detected no longer.

The aforementioned head shifting is gently accomplished by minimal changes in air pressure. This is particularly due to the trapezoidal shape of laterally spaced chambers 14 and 15. The position of the head may be changed without any loss of head support at the back regions of the user's head and neck. The principal advantage of therapeutic cushions constructed in accordance with the present invention, as compared to "state of the art" products consists in the ability to change the heads position without loss of individual ergonomy. Also rotating the head e.g. to left and front or to left and rear, in accordance with a predetermined algorithm, is much more effective and is made possible by the described substantial lateral contact area between the user's head and the head supporting surfaces of the chambers 14, 15. Such movements can be readily effected by subtle changes within the trapezoidally shaped chambers 14 and 15. Equally indispensable in the case of heavy snorers is the neck supporting chamber 16, which is capable of effecting additional changes in head position to the rear and front.

In case that the ergonomic function is required only, the therapeutic function of the governing unit is dispensable. Likewise, it may be desirable to monitor one or more other characteristics or behaviors of a sleeping individual besides or instead of snoring such, for example, as sleep apnea and the like, and to incorporate an algorithm configured to selectively inflate and/or deflate respective chambers in order to bring about an alteration in such other or additional monitored characteristic(s) or behavior(s). As such, a therapeutic cushion constructed in accordance with the present invention responds to an increasing demand for health, stress-reduction and wellness.

What is claimed is:

1. A dynamically adjustable therapeutic support system for supporting a head and neck of a user at rest on the therapeutic support system, the dynamically adjustable therapeutic support system comprising:

an expandable first chamber defining an interior volume adapted to receive and store a fluid under pressure, said first chamber having a first flexible outer surface region dimensioned and arranged to support a top region of the head of a user at rest;

an expandable second chamber defining an interior volume adapted to receive and store a fluid under pressure, said second chamber having a second flexible outer surface region dimensioned and arranged to support the neck of a user at rest, a gap region region disposed between said first and second chambers;

an expandable third chamber coupled at one end to said first chamber and at another end to said second chamber;

an expandable fourth chamber coupled at one end to said first chamber and at another end to said second chamber, wherein lower sidewall portions of said first, second, third and fourth chambers are dimensioned and arranged to be supported on a common plane and to define a gap region having a lateral dimension and extending up from said common plane for receiving and supporting the head of a user at rest;

a pump; and a control circuit operative to establish fluid communication between said pump and each of said expandable chambers and responsive to detection of one of a characteristic and a behavior indicative of a sleep disorder to alter a pressurization within each of said expandable chambers so as to reposition said head supported by the first and second flexible outer surface regions, the spaced surfaces of the third and fourth upper chambers having a combined lateral dimension that is greater than the lateral dimension of the gap region, whereby by changing pressure in the third or fourth upper chambers, a user's head, supported by the spaced side surface on the third or fourth chambers, can be repositioned by being rotated.

2. The dynamically adjustable therapeutic support system according to claim 1, wherein said behavior is persistent snoring indicative of a respiratory disturbance, and wherein said dynamically adjustable therapeutic support system further includes a microphone and a sound detection circuit for detecting acoustic energy.

3. The dynamically adjustable therapeutic support system according to claim 2, wherein said control circuit is coupled to an output of said sound detection circuit and is operative to identify acoustic energy indicative of snoring and to remove fluid from the first chamber.

4. The dynamically adjustable therapeutic support system according to claim 2, wherein said control circuit is coupled to an output of said sound detection circuit and is operative to identify acoustic energy indicative of snoring and to operate a pump to cause additional fluid to enter the first chamber.

5. The dynamically adjustable therapeutic support system according to claim 4, wherein said control circuit is further operative to remove fluid from the second chamber.

6. The dynamically adjustable therapeutic support system according to claim 1, wherein said control circuit includes a first pressure sensor in fluid communication with said first chamber and a second pressure sensor in fluid communication with said second chamber, and wherein the control circuit is operative to execute an algorithm for dynamically regulating the pressure within each of said chambers upon detection of a respiratory disturbance.

7. The dynamically adjustable therapeutic support system according to claim 6, wherein said algorithm is a learning algorithm configured to remember which combination of pressures in each chamber result in a maximum attenuation of a detected respiratory disturbance.

8. The dynamically adjustable therapeutic support system according to claim 1, further including a man machine interface operative to receive user instructions for obtaining a selected level of pressurization within each of said first and second chambers, said control unit being responsive to said user instructions to implement said selected levels of pressurization as a baseline.

9. The dynamically adjustable therapeutic support system according to claim 8, wherein said man machine interface is a hand-held remote control device.

10. The dynamically adjustable therapeutic support system according to claim 1, further including an expandable fifth chamber underlying said first, second, third and fourth chambers, said fifth chamber defining an interior volume for introduction of additional fluid for an increase in elevation of said common plane and withdrawal of fluid for a decrease in elevation of said common plane.

11. The dynamically adjustable therapeutic support system according to claim 1, wherein said control circuit is operative to implement therapeutically effective adjustments in the orientation of said head at rest relative to three orthogonal axes by altering a pressurization with each of said first, second, third and fourth chambers.

12. A dynamically adjustable therapeutic support system for supporting a head and neck of a user at rest on the dynamically adjustable therapeutic support system, said dynamically adjustable therapeutic support system comprising:

a lower member defining a first upper surface region;

an expandable first upper chamber overlying the first upper surface region of said lower member, the first upper chamber defining an interior volume for receiving and storing a fluid under pressure and configured to engage a top of the head of a user at rest;

an expandable second upper chamber overlying a second upper surface region of said lower member, the second upper chamber defining an interior volume for receiving and storing a fluid under pressure and configured to engage the neck of a user at rest;

third and fourth expandable upper chambers overlying respective intermediate regions of said lower member and defining corresponding interior volumes for receiving and storing a fluid under pressure, the third and fourth upper chambers each between the first and second upper chambers and separated from each other by a gap region having a lateral dimension and defining spaced surfaces to separately support side surfaces of the head of a user at rest;

a pump; and a control circuit operative to establish fluid communication between said pump and each of said expandable chambers and responsive to detection of one of a characteristic and a behavior indicative of a sleep disorder to alter a pressurization within at least one of said expandable chambers so as to reposition the user's head, the spaced surfaces of the third and fourth upper chambers having a combined lateral dimension that is greater than the lateral dimension of the gap region, whereby by changing pressure in the third or fourth upper chambers, a user's head, supported by the spaced side surface on the third or fourth chambers, can be repositioned by being rotated.

13. The dynamically adjustable therapeutic support system according to claim 12, wherein the lower member comprises a lower chamber defining an interior volume for receiving and storing a fluid under pressure and the pump is operative to alter pressurization of the interior volume of the lower chamber to thereby adjust a height of said head supporting surface.

14. The dynamically adjustable therapeutic support system according to claim 12, wherein the interior volume of each upper chamber is independently adjustable by a user to achieve an ergonomic arrangement suited to any individual user.

15. The dynamically adjustable therapeutic support system according to claim 12, wherein said behavior is snoring and the gap/region has a trapezoid shape whereby a short edge of said gap region lies next to said first upper chamber and a long edge of said gap/region lies next to said second upper chamber.

16. The dynamically adjustable therapeutic support system according to claim 12, wherein said control circuit includes an electronic control unit and a plurality of pressure sensors coupled to the electronic control unit, each respective pressure sensor being arranged for fluid communication with a corresponding one of said expandable chambers and the electronic control unit being operative to execute an algorithm for regulating the pressure within each of said expandable chambers.

17. The method of configuring a dynamically adjustable therapeutic support system according to claim 12 wherein the third and fourth expandable upper chambers directly contact the lower member.

18. A method of using the dynamically adjustable therapeutic support system of claim 13, said method comprising the steps of:

selectively pressurizing said expandable lower chamber, said expandable first upper chamber, said expandable second upper chamber, said expandable third upper chamber, and said expandable fourth upper chamber;

detecting one of a characteristic and a behavior indicative of a sleep disorder;

altering, in a first adjustment step, a pressurization within at least one of said expandable chambers in response to detection of the characteristic; and altering, in a second adjustment step, a pressurization within at least one of said expandable chambers in response to detection of the characteristic.

19. The method of claim 18, wherein said detecting step includes detecting acoustic energy indicative of a respiratory disturbance.

20. A method of configuring a dynamically adjustable therapeutic support system for use by a sleeping individual, the method comprising the steps of:

a) providing a dynamically adjustable therapeutic support system comprising:

an expandable lower chamber defining an interior volume for receiving and storing a fluid under pressure;

an expandable first upper chamber overlying a first upper surface region of said lower chamber and defining an interior volume for receiving and storing a fluid under pressure;

an expandable second upper chamber overlying a second upper surface region of said lower chamber and defining an interior volume for receiving and storing a fluid under pressure;

third and fourth expandable upper chambers overlying third and fourth upper surface regions of said lower chamber between the first and second upper surface regions, the third and fourth expandable upper chamber defining respective third and fourth interior volumes for receiving and storing a fluid under pressure and third and fourth surfaces, the third and fourth upper chambers spaced from each other to define a gap between: a) the third and fourth upper chambers; and b) the first and second upper chambers, a pump; and a control circuit operative to establish fluid communication between said pump and each of said expandable chambers and responsive to detection of one of a characteristic and a behavior indicative of a sleep disorder to alter a pressurization within at least one of said expandable chambers so as to reposition the individual's head;

b) operatively positioning the dynamically adjustable therapeutic device relative to the individual so that a back region of the individual's head resides in the gap and laterally opposite sides of the individual's head are separately supported in the gap by the third and fourth surfaces and a surface of the first upper chamber is situated to allow a supporting force to be exerted upon the top of the individual's head;

c) causing the dynamically adjustable therapeutic support to detect one of a characteristic and a behavior indicative of a sleep disorder; and d) in response to the detection of one of a characteristic and a behavior indicative of a sleep disorder, causing the pump to operate to alter pressurization within at least one of the expandable chambers to reposition the individual's head.

21. The method of configuring a dynamically adjustable therapeutic support system according to claim 20 wherein the gap has a trapezoidal shape whereby a short edge of the gap lies next to the first upper chamber and a long edge of the gap lies next to the second upper chamber.

* * * * *